US006916414B2

(12) United States Patent
Dolan

(10) Patent No.: US 6,916,414 B2
(45) Date of Patent: Jul. 12, 2005

(54) LIGHT METAL ANODIZATION

(75) Inventor: Shawn E. Dolan, Sterling Heights, MI (US)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 171 days.

(21) Appl. No.: 10/162,965

(22) Filed: Jun. 5, 2002

(65) Prior Publication Data

US 2003/0070936 A1 Apr. 17, 2003

Related U.S. Application Data

(63) Continuation-in-part of application No. 10/033,554, filed on Oct. 19, 2001, now abandoned, which is a continuation-in-part of application No. 09/968,023, filed on Oct. 2, 2001, now abandoned.

(51) Int. Cl.[7] ..... C25D 19/00

(52) U.S. Cl. ..... 205/316; 205/318; 205/321; 205/323; 205/324; 205/325; 205/326; 205/332

(58) Field of Search ..... 205/316, 318, 205/321, 323, 324, 325, 326, 332

(56) References Cited

U.S. PATENT DOCUMENTS

| | | | | |
|---|---|---|---|---|
| 29,739 | A | | 9/1860 | Kessler |
| 2,305,669 | A | | 12/1942 | Budiloff et al. |
| 2,880,148 | A | | 3/1959 | Evangelides |
| 2,901,409 | A | | 8/1959 | DeLong |
| 2,926,125 | A | | 2/1960 | Currah et al. |
| 3,345,276 | A | | 10/1967 | Munroe |
| 3,620,940 | A | | 11/1971 | Wick |
| 3,824,159 | A | | 7/1974 | Wehrmann |
| 3,945,899 | A | | 3/1976 | Nikaido et al. |
| 3,956,080 | A | | 5/1976 | Hradcovsky et al. |
| 3,960,676 | A | | 6/1976 | Miyosawa et al. |
| 3,996,115 | A | | 12/1976 | Kessler |
| 4,082,626 | A | * | 4/1978 | Hradcovsky ..... 205/106 |
| 4,166,777 | A | | 9/1979 | Casson, Jr. et al. |
| 4,184,926 | A | | 1/1980 | Kozak |
| 4,188,270 | A | | 2/1980 | Kataoka |
| 4,227,976 | A | | 10/1980 | Menke |
| 4,383,897 | A | | 5/1983 | Gillich et al. |
| 4,399,021 | A | | 8/1983 | Gillich et al. |
| 4,439,287 | A | | 3/1984 | Birkle et al. |
| 4,448,647 | A | | 5/1984 | Gillich et al. |
| 4,452,674 | A | | 6/1984 | Gillich et al. |
| 4,551,211 | A | | 11/1985 | Kobayashi et al. |
| 4,578,156 | A | | 3/1986 | Plazter |
| 4,620,904 | A | | 11/1986 | Kozak |
| 4,659,440 | A | * | 4/1987 | Hradcovsky ..... 205/106 |
| 4,744,872 | A | | 5/1988 | Kobayashi et al. |
| 4,839,002 | A | * | 6/1989 | Pernick et al. ..... 205/83 |
| 4,859,288 | A | | 8/1989 | Furneaux et al. |
| 4,869,789 | A | | 9/1989 | Kurze et al. |
| 4,976,830 | A | | 12/1990 | Schmeling et al. |
| 4,978,432 | A | | 12/1990 | Schmeling et al. |
| 5,240,589 | A | | 8/1993 | Bartak et al. |
| 5,264,113 | A | | 11/1993 | Bartak et al. |
| 5,266,412 | A | | 11/1993 | Bartak et al. |
| 5,275,713 | A | | 1/1994 | Hradcovsky |
| 5,385,662 | A | | 1/1995 | Kurze et al. |
| 5,470,664 | A | | 11/1995 | Bartak et al. |
| 5,700,366 | A | | 12/1997 | Steblianko et al. |
| 5,775,892 | A | | 7/1998 | Miyasaka et al. |

(Continued)

FOREIGN PATENT DOCUMENTS

| | | |
|---|---|---|
| DE | 289065 A5 | 4/1991 |
| DE | 4104847 | 8/1992 |
| EP | 0 978 576 | 2/2000 |
| GB | 294237 | 9/1929 |
| GB | 493935 | 10/1938 |
| JP | 57 060098 | 4/1982 |
| JP | 58 001093 | 1/1983 |
| JP | 59 016994 | 1/1984 |
| WO | WO 92/14868 | 9/1992 |
| WO | WO 98/42892 | 3/1998 |
| WO | WO 99/02759 | 7/1998 |
| WO | WO 98/42895 | 10/1998 |
| WO | WO 00/03069 | 1/2000 |
| WO | WO02/28838 A2 | 4/2002 |

OTHER PUBLICATIONS

Barton et al., The Effect of Electrolyte on the Anodized Finish Of a Magnesium Alloy, Plating & Surface Finishing, May 1995, pp. 138–141.

Sworn Declaration of Dr. Peter Kurze dated Jul. 5, 2000, submitted in connectin with PCT Publication WO96/28591 of Magnesium Technology Limited.

DE 4104847 abstract, Aug. 1992.

FR 2549092 abstract, Jan. 1985.

Zozulin, Alex J.; "A Chromate–Free Anodize Process for Mangesium Alloys: A Coating with Superior Characteristics", pp 47–63, no date avail.

Zozulin, et al.; "Anodized Coatings for magnesium Alloys", Metal Finishing, Mar., 1994, pp. 39–44.

IBM Technical Disclosure Bulletin, "Forming Protective Coatings on Magnesium Alloys", Dec., 1967, p. 862.

Jakobson, et al.; American Electroplaters and Surface Finishers Society, pp. 541–550, no date avail.

Barton, et al.; "The Effect of electrolyte on the Anodized Finish of a magnesium Alloy"; Plating & Surface Finishing, pp. 138–141, no date avail.

*Primary Examiner*—Wesley Nicolas
(74) *Attorney, Agent, or Firm*—Stephen D. Harper; Mary K. Cameron

(57) ABSTRACT

Using pulsed current and relatively low average voltages, articles containing light metals such as magnesium may be rapidly anodized to form protective surface coatings. The anodizing solutions employed may contain phosphate, permanganate, silicate, zirconate, vanadate, titanate, hydroxide, alkali metal fluoride and/or complex fluoride, optionally with other components present.

63 Claims, No Drawings

U.S. PATENT DOCUMENTS 5,792,335 A 8/1998 Barton
5,811,194 A 9/1998 Kurze et al.
5,837,117 A 11/1998 Allegret
5,958,604 A 9/1999 Riabkov et al.
5,981,084 A 11/1999 Riabkov et al.
6,059,897 A 5/2000 Koerner et al.
6,153,080 A * 11/2000 Heimann et al. ..... 205/199
6,159,618 A 12/2000 Danroc et al.
6,197,178 B1 3/2001 Patel et al.
6,280,598 B1 8/2001 Barton et al.
6,335,099 B1 1/2002 Higuchi et al.
2003/0000847 A1 * 1/2003 Ostrovsky ..... 205/321

* cited by examiner

LIGHT METAL ANODIZATION

This application is a continuation-in-part of application Ser. No. 10/033,554, filed Oct. 19, 2001 now abandoned, which is a continuation-in-part of application Ser. No. 09/968,023, filed Oct. 2, 2001 now abandoned.

FIELD OF THE INVENTION

This invention relates to the anodization of light metals such as magnesium and aluminum using pulsed current of low average voltage to provide corrosion-, heat- and abrasion-resistant coatings.

BACKGROUND OF THE INVENTION

Magnesium, aluminum and their alloys have found a variety of industrial applications. However, because of the reactivity of such light metals, and their tendency toward corrosion and environmental degradation, it is necessary to provide the exposed surfaces of these metals with an adequate corrosion-resistant and protective coating. Further, such coatings should resist abrasion so that the coatings remain intact during use, where the metal article may be subjected to repeated contact with other surfaces, particulate matter and the like. Where the appearance of articles fabricated of light metals is considered important, the protective coating applied thereto should additionally be uniform and decorative. Heat resistance is also a very desirable feature of a light metal protective coating.

In order to provide an effective and permanent protective coating on light metals, such metals have been anodized in a variety of electrolyte solutions. While anodization of aluminum, magnesium and their alloys is capable of forming a more effective coating than painting or enameling, the resulting coated metals have still not been entirely satisfactory for their intended uses. The coatings frequently lack the desired degree of hardness, smoothness, durability, adherence, heat resistance, corrosion resistance, and/or imperviousness required to meet the most demanding needs of industry. Additionally, many of the light metal anodization processes developed to date have serious shortcomings which hinder their industrial practicality. Some processes, for example, require the use of high voltages, long anodization times and/or volatile, hazardous substances.

One method of magnesium anodization is described in U.S. Pat. No. 5,792,335. This method involves the use of an electrolytic solution containing ammonia. A magnesium-based material is placed as an anode in the electrolytic solution, together with a cathode, and a current is passed between the anode and the cathode through the electrolytic solution so that a coating is formed on the magnesium-based material.

Such a process is somewhat difficult to implement on a commercial scale due to the requirement that ammonia be present (preferably, at a concentration of 5–7% w/v) in the electrolytic solution. Due to the volatile and corrosive character of ammonia, the equipment used in such a process must be carefully designed and operated so as to prevent the escape of ammonia from the electrolytic bath into the workplace. This requirement will substantially increase the cost of implementing and operating an anodization process of this type.

The aforementioned patent also teaches that the electrolytic solution may contain a phosphate compound, but cautions that the use of phosphate concentration greater than 0.2M should be avoided because of surface appearance problems. The preferred phosphate compound concentration is from 0.05 to 0.08M. The patent further teaches that the process should be conducted using relatively high voltage direct current (i.e., 170 to 350 volts) and that spark formation during operation of the process should be avoided in order to minimize the current drawn and to prevent the bath temperature from increasing to an unfavorable extent.

While the aforedescribed process is capable of producing good quality, corrosion-resistant coatings on magnesium materials, the rate of coating formation (typically, 1–3 microns per minute) is lower than would be desirable.

Thus, there is still considerable need to develop alternative anodization processes for light metals which do not have any of the aforementioned shortcomings and yet still furnish corrosion-, heat- and abrasion-resistant protective coatings of high quality.

SUMMARY OF THE INVENTION

Light metal-containing articles may be rapidly anodized to form protective coatings that are resistant to corrosion and abrasion using relatively low voltage pulsed current and specific types of anodizing solutions. The use of the term "solution" herein is not meant to imply that every component present is necessarily fully dissolved and/or dispersed. The anodizing solution is aqueous and contains one or more water-soluble and/or water-dispersible anionic species containing a metal, metalloid, and/or non-metal element. In especially preferred embodiments of the invention, the anodizing solution comprises one or more components selected from one of the following:

a) water-soluble and water-dispersible phosphorus oxysalts, wherein the phosphorous concentration in the anodizing solution is at least 0.3M;
b) water-soluble and water-dispersible silicon oxysalts;
c) water-soluble and water-dispersible complex fluorides of elements selected from the group consisting of Ti, Zr, Hf, Si, Sn, Al, Ge and B;
d) water-soluble and water-dispersible manganese oxysalts;
e) water-soluble and water-dispersible zirconium oxysalts;
f) water-soluble and water-dispersible vanadium oxysalts;
g) water-soluble and water-dispersible titanium oxysalts;
h) water-soluble and water-dispersible alkali metal fluorides; and
i) water-soluble and water-dispersible alkali metal hydroxides.

The method of the invention comprises providing a cathode in contact with the anodizing solution, placing the light metal-containing article as an anode in the anodizing solution, and passing a pulsed current having an average voltage of not more than 250 volts through the anodizing solution for a time effective to form the protective coating on the surface of the light metal-containing article. In certain embodiments of the invention, the average voltage is preferably not more than 200 volts or, more preferably, not more than 175 volts, depending on the composition of the anodizing solution selected.

DETAILED DESCRIPTION OF THE INVENTION

Except in the claims and the operating examples, or where otherwise expressly indicated, all numerical quantities in this description indicating amounts of material or conditions of reaction and/or use are to be understood as modified by the word "about" in describing the scope of the invention. Practice within the numerical limits stated is generally preferred, however. Also, throughout the description, unless expressly stated to the contrary: percent, "parts of", and ratio values are by weight or mass; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) between one or more newly added constituents and one or more constituents already present in the composition when the other constituents are added; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise, such counterions may be freely selected, except for avoiding counterions that act adversely to an object of the invention; the word "mole" means "gram mole", and the word itself and all of its grammatical variations may be used for any chemical species defined by all of the types and numbers of atoms present in it, irrespective of whether the species is ionic, neutral, unstable, hypothetical or in fact a stable neutral substance with well defined molecules; and the terms "solution", "soluble", "homogeneous", and the like are to be understood as including not only true equilibrium solutions or homogeneity but also dispersions that show no visually detectable tendency toward phase separation over a period of observation of at least 100, or preferably at least 1000, hours during which the material is mechanically undisturbed and the temperature of the material is maintained at ambient room temperatures (18 to 25° C.).

There is no specific limitation on the light metal article to be subjected to anodization in accordance with the present invention. Preferably, at least a portion of the article is fabricated from a metal that contains not less than 50% by weight, more preferably not less than 70% by weight, magnesium or aluminum. The anodization treatment is advantageously applicable to magnesium-base alloys containing one or more other elements such as Al, Zn, Mn, Zr, Si and rare earth metals.

In carrying out the anodization of a light metal article, an anodizing solution is employed which is preferably maintained at a temperature between about 5° C. and about 90° C.

The anodization process comprises immersing at least a portion of the light metal article in the anodizing solution, which is preferably contained within a bath, tank or other such container. The light metal article functions as the anode. A second metal article that is cathodic relative to the light metal article is also placed in the anodizing solution. Alternatively, the anodizing solution is placed in a container which is itself cathodic relative to the light metal article (anode). An average voltage potential not in excess of 250 volts, preferably not in excess of 200 volts, most preferably not in excess of 175 volts is then applied across the electrodes in a pulsing manner until a coating of the desired thickness is formed on the surface of the light metal article in contact with the anodizing solution. When certain electrolytes are used, good results may be obtained even at average voltages not in excess of 125 volts. It has been observed that the formation of a corrosion- and abrasion-resistant protective coating is typically associated with anodization conditions which are effective to cause a visible light-emitting discharge (sometimes referred to herein as a "plasma", although the use of this term is not meant to imply that a true plasma exists) to be generated (either on a continuous or intermittent or periodic basis) on the surface of the light metal article. This was quite unexpected in the view of the warnings in the prior art about the need to avoid the formation of "sparks" in an anodization process if satisfactory coatings are to be obtained (see, for example, U.S. Pat. No. 5,792,335).

It has been found that the use of pulsed or pulsing current is critical. Direct current is preferably used, although alternating current may also be utilized (generally, the rate of coating formation will be lower using AC). The frequency of the current is not believed to be critical, but typically may range from 10 to 1000 Hertz. The "off" time between each consecutive voltage pulse preferably lasts between about 10% as long as the voltage pulse and about 1000% as long as the voltage pulse. During the "off" period, the voltage need not be dropped to zero (i.e., the voltage may be cycled between a relatively low baseline voltage and a relatively high ceiling voltage). The baseline voltage thus may be adjusted to a voltage which is from 0% to 99.9% of the peak applied ceiling voltage. Low baseline voltages (e.g., less than 30% of the peak ceiling voltage) tend to favor the generation of a periodic or intermittent visible light-emitting discharge, while higher baseline voltages (e.g., more than 60% of the peak ceiling voltage) tend to result in continuous plasma anodization (relative to the human eye frame refresh rate of 0.1–0.2 seconds). The current can be pulsed with either electronic or mechanical switches activated by a frequency generator. Typically, the current density will be from 100 to 300 amps/$m^2$. More complex waveforms may also be employed, such as, for example, a DC signal having an AC component.

A number of different types of anodizing solutions may be successfully used in the process of this invention, as will be described in more detail hereinafter. However, it is believed that a wide variety of water-soluble or water-dispersible anionic species containing metal, metalloid, and/or non-metal elements are suitable for use as components of the anodizing solution. Representative elements include, for example, phosphorus, silicon, titanium, zirconium, hafnium, tin, germanium, boron, vanadium, fluoride, zinc and the like (including combinations of such elements). Without wishing to be bound by theory, it is thought that the anodization of light metals in the presence of such species using low voltage pulsed current leads to the formation of surface films comprised of metal/metalloid oxide ceramics (including partially hydrolyzed glasses containing O, OH and/or F ligands) or light metal/non-metal compounds. The low voltage plasma or sparking which occurs during anodization is believed to destabilize the anionic species, causing certain ligands or substituents on such species to be hydrolyzed or displaced by O and/or OH or metal-organic bonds to be replaced by metal-O or metal-OH bonds. Such hydrolysis and displacement reactions render the species less water-soluble or water-dispersible, thereby driving the formation of the surface coating.

In certain embodiments of the invention, the anodizing solution is essentially (more preferably, entirely) free of ammonia, chromium, permanganate, borate, sulfate, free fluoride and/or free chloride. Especially preferred embodiments of the invention are as follows.

Embodiment A

In this embodiment of the invention, the anodizing solution used comprises water, water-soluble or water-dispersible phosphorus oxysalt such as phosphate, and optionally, water-soluble amine. Preferably, the pH of the anodizing solution is neutral to basic (more preferably, about 7.1 to about 12). One or more water-soluble amines may be utilized, preferably an organic amine having a relatively low volatility (e.g., having a boiling point at atmospheric pressure of at least about 100° C., more preferably at least about 150° C., most preferably at least about 200° C.). Examples of especially preferred classes of water-soluble amines suitable for use in the present invention include alkanolamines and polyetheramines (polyoxyalkylene amines). The concentration of water-soluble amine in the anodizing solution preferably is in the range of from about 0.05 to about 1 moles/liter (M).

The phosphorus oxysalt may be supplied from any suitable source such as, for example, ortho-phosphoric acid, pyro-phosphoric acid, tri-phosphoric acid, meta-phosphoric acid, polyphosphoric acid and other combined forms of phosphoric acid and may be present in the anodizing solution in partially or fully neutralized form (e.g., as a salt, wherein the counter ion(s) are alkali metal cations, ammonium or other such species that render the phosphorus oxysalt water-soluble). Potassium salts of phosphoric acid are especially preferred because of their high water solubility. Organophosphates such as phosphonates and the like may also be used (for example, the various phosphonates sold by Solutia under the trademark DEQUEST). The phosphorus concentration in the anodizing solution should be at least 0.3 M, preferably at least 0.4 M, and most preferably at least 0.5 M. Preferably, the concentration of alkali metal (Li, K, Na) in the anodizing solution is at least 0.3 M.

With the aforedescribed anodizing solutions, the generation of a sustained "plasma" (visible light emitting discharge) during anodization is generally attained using pulsed DC having an average voltage of no more than 150 volts. In preferred operation, the average voltage does not exceed 100 volts. Rapid anodization of a magnesium substrate may in some instances be readily achieved at an average voltage of no more than 80 volts.

Embodiment B

In this embodiment of the invention, the anodizing solution used comprises water and water-soluble or water-dispersible silicon oxysalt (e.g., silicate). Alkali metal salts of silicic acid and related species are especially suitable for use, particularly the potassium and sodium metasilicates, disilicates, orthosilicates, polysilicates, and pyrosilicates. The silicon atom concentration in the anodizing solution preferably is at least about 0.4M, more preferably at least 0.8M, most preferably at least about 1.2M. The anodizing solution preferably is basic (more preferably, having a pH of from about 8 to not more than 12). The anodizing solution, in certain embodiments, is essentially free of alkali metal hydroxide and/or fluorides and/or fluorosilicates.

With the aforedescribed anodizing solutions, the generation of sustained plasma during anodization is generally obtained using pulsed DC having an average voltage of no more than 100 volts. In preferred operation, the average voltage does not exceed 75 volts.

Embodiment C

In this embodiment of the invention, the anodizing solution used comprises water and a complex fluoride of an element selected from the group consisting of Ti, Zr, Hf, Si, Sn, Al, Ge and B (preferably, Ti, Zr and/or Si). The complex fluoride should be water-soluble or water-dispersible and preferably comprises an anion comprising at least 4 fluorine atoms and at least one atom of an element selected from the group consisting of Ti, Zr, Hf, Si, Sn, Al, Ge or B. The complex fluorides (sometimes referred to by workers in the field as "fluorometallates") preferably are substances with molecules having the following general empirical formula (I):

$$H_pT_qF_rO_s$$

wherein: each of p, q, r, and s represents a non-negative integer; T represents a chemical atomic symbol selected from the group consisting of Ti, Zr, Hf, Si, Sn, Al, Ge, and B; r is at least 4; q is at least 1 and preferably is not more than, with increasing preference in the order given, 3, 2, or 1; unless T represents B, (r+s) is at least 6; s preferably is not more than, with increasing preference in the order given, 2, 1, or 0; and (unless T represents Al) p is preferably not more than (2+s), with all of these preferences being preferred independently of one another. One or more of the H atoms may be replaced by suitable cations such as ammonium, metal, or alkali metal cations (e.g., the complex fluoride may be in the form of a salt, provided such salt is water-soluble or water-dispersible).

Illustrative examples of suitable complex fluorides include, but are not limited to, $H_2TiF_6$, $H_2ZrF_6$, $H_2HfF_6$, $H_2SiF_6$, $H_2GeF_6$, $H_2SnF_6$, $H_3AlF_6$, and $HBF_4$ and salts (fully as well as partially neutralized) and mixtures thereof. Examples of suitable complex fluoride salts include $SrSiF_6$, $MgSiF_6$, $Na_2SiF_6$ and $Li_2SiF_6$. The concentration of complex fluoride preferably is at least about 0.005 M. Generally speaking, there is no preferred upper concentration limit, except of course for any solubility constraints.

To improve the solubility of the complex fluoride, especially at higher pH, it may be desirable to include an inorganic acid (or salt thereof) that contains fluorine but does not contain any of the elements Ti, Zr, Hf, Si, Sn, Al, Ge or B in the electrolyte composition. Hydrofluoric acid or a salt of hydrofluoric acid such as ammonium bifluoride is preferably used as the inorganic acid. The inorganic acid is believed to prevent or hinder premature polymerization or condensation of the complex fluoride, which otherwise (particularly in the case of complex fluorides having an atomic ratio of fluorine to T of 6) may be susceptible to slow spontaneous decomposition to form a water-insoluble oxide. Certain commercial sources of hexafluorosilicic acid, hexafluorotitanic acid and hexafluorozirconic acid are supplied with an inorganic acid or salt thereof, but it may be desirable in certain embodiments of the invention to add still more inorganic acid or inorganic salt. A chelating agent, especially a chelating agent containing two or more carboxylic acid groups per molecule such as nitrilotriacetic acid, ethylene diamine tetraacetic acid, N-hydroxyethylethylenediamine triacetic acid, or diethylene-triamine pentaacetic acid or salts thereof, may also be included in the anodizing solution.

In a further variation of this embodiment of the invention, the anodizing solution is additionally comprised of at least one compound which is an oxide, hydroxide, carbonate, carboxylate or alkoxide of at least one element selected from the group consisting of Ti, Zr, Si, Hf, Sn, B, Al, or Ge. Salts of such compounds may also be used (e.g., titanates, zirconates, silicates). Examples of suitable compounds of this type which may be used to prepare the anodizing solutions of the present invention include, without limitation, silica, zirconium basic carbonate, zirconium acetate and zirconium hydroxide.

If present, the concentration of this compound in the anodizing solution is preferably at least, in increasing preference in the order given, 0.0001, 0.001 or 0.005 moles/kg (calculated based on the moles of the element(s) Ti, Zr, Si, Hf, Sn, B, Al and/or Ge present in the compound used). Independently, the ratio of the concentration of moles/kg of complex fluoride to the concentration in moles/kg of the oxide, hydroxide, carbonate or alkoxide compound preferably is at least, with increasing preference in the order given, 0.05:1, 0.1:1, or 1:1.

In general, it will be preferred to maintain the pH of the anodizing solution in this embodiment in the range of from mildly acidic to mildly basic (e.g., a pH of from about 5 to about 11). A base such as ammonia, amine or alkali metal hydroxide may be used, for example, to adjust the pH of the anodizing solution to the desired value. Rapid coating formation is generally observed at average voltages of 125 volts or less (preferably 100 or less), using pulsed DC.

A particularly preferred anodizing solution for use in forming a white protective coating on an aluminum or aluminum alloy substrate may be prepared using the following components:

| | |
|---|---|
| Zirconium Basic Carbonate | 0.01 to 1 wt. % |
| $H_2ZrF_6$ | 0.1 to 5 wt. % |
| Water | Balance to 100% |

pH adjusted to 3–5 using ammonia, amine or other base

The resulting anodizing solution permits rapid anodization of light metal-containing articles using pulsed direct current having an average voltage of not more than 100 volts. In this particular embodiment of the invention, better coatings are generally obtained when the anodizing solution is maintained at a relatively high temperature during anodization (e.g., 50 degrees C. to 80 degrees C.). The solution has the further advantage of forming protective coatings which are white in color, thereby eliminating the need to paint the anodized surface if a white decorative finish is desired. To the best of the inventor's knowledge, no anodization technologies being commercially practiced today are capable of producing white coatings.

Embodiment D

In this embodiment of the invention, the anodizing solution used comprises water and a water-soluble or water-dispersible oxysalt of manganese such as a permanganate. The anodizing solution may be essentially free of components other than water, manganese oxysalt and species added for the purpose of controlling pH. Examples of suitable manganese oxysalts include lithium permanganate, sodium permanganate, potassium permanganate, ammonium permanganate, calcium permanganate, barium permanganate, magnesium permanganate, and strontium permanganate. The manganese atom concentration in the anodizing solution preferably is at least about 0.01M, more preferably at least about 0.03M. The anodizing solution preferably is acidic to neutral (e.g., a pH of from about 1 to about 7). The pH of the solution may be adjusted as desired using acid (e.g., a mineral acid such as sulfuric acid) or base.

In this embodiment of the invention, rapid coating formation is generally observed at an average voltage of 200 volts or less using pulsed direct current.

Embodiment E

In this embodiment of the invention, a water-soluble or water-dispersible oxysalt containing an element selected from V, Zr, Ti, Hf and combinations thereof is present in the aqueous anodizing solution. Suitable species of this type include vanadates, zirconates, titanates and hafnates, with zirconates and vanadates being especially preferred. Decavanadates such as sodium ammonium decavanadate are especially preferred. Water-soluble forms of zirconium carbonate are also preferred for use. Other metals such as zinc may also be present. For example, solutions of zinc ammonium zirconium carbonate can be advantageously employed as the anodizing solution. A sustained plasma and rapid coating formation may typically be attained in this embodiment of the invention at an average voltage of not more than 150 volts.

The pH of the solution may be adjusted as desired using acid or base. For example, the solution may be rendered strongly basic (pH greater than 11, but preferably no greater than 14) by the addition of an alkali metal hydroxide such as potassium hydroxide.

The anodizing solution may additionally comprise one or more chelating agents such as, for example, the chelating agents described herein in connection with Embodiment C. Typical chelating agent concentrations are from 0.5 to 20 g/L.

Embodiment F

In this embodiment of the invention, a water-soluble or water-dispersible alkali metal fluoride is present in the aqueous anodizing solution. The coating formed during anodization is typically comprised of light metal (Al and/or Mg), alkali metal, fluorine and oxygen. Potassium fluoride, sodium fluoride, lithium fluoride and combinations or mixtures thereof may be used as components of the anodizing solution. For example, an aqueous anodizing solution may be used which contains about 15 to about 60 (more preferably, about 25 to about 45) g/L potassium fluoride or other alkali metal fluoride and which has a pH of from about 7 to about 13. Very uniform coatings having good corrosion resistance may be obtained even on extremely poor quality light metal castings. Unlike most of the other embodiments of this invention, satisfactory anodization results may be obtained in the absence of any visible light-emitting discharge. When pulsed direct current (10 milliseconds on time, 10 milliseconds off time) is applied at an operating bath temperature of from about 50° C. to about 80° C., a coating 5–10 microns in thickness may be achieved within 2–3 minutes at an average voltage of about 100 volts (250 peak voltage). The coating thereby obtained exhibits only 0–1% corrosion after 240 hours salt fog exposure (ASTM 50). Typically, the average voltage in this embodiment of the invention is not greater than about 125 volts.

In this embodiment of the invention, it is not necessary for the aqueous anodizing solution to contain any component other than the alkali metal fluoride. For example, the solution may be free or essentially free of hydroxide and/or silicate, yet remain capable of providing good quality anodized coatings within a short period of time using pulsed current. This was quite unexpected in view of U.S. Pat. Nos. 4,620,904, 5,266,412, 5,264,113, 5,240,589 and 5,470,664, which teach electrolytes containing relatively high levels of hydroxide and silicate in addition to fluoride. Preferably, the aqueous anodizing solutions of this embodiment of the invention contain less than 2 g/L (more preferably, less than 1 g/L, most preferably, less than 0.5 g/L) hydroxide and less than 5 g/L (more preferably, less than 3 g/L, most preferably, less than 1 g/L) silicate. Optionally, however, an alkali metal hydroxide or other base may be added to the anodizing solution for purposes of adjusting pH.

Embodiment G

In this embodiment of the invention, a water-soluble or water-dispersible alkali metal hydroxide such as lithium hydroxide, sodium hydroxide, potassium hydroxide or mixtures thereof is present in the aqueous anodizing solution. Mixtures of different alkali metal hydroxides may be used. It is not critital to include components other than alkali metal hydroxide and in certain embodiments of the invention the aqueous anodizing solution is free or essentially free of any dissolved or dispersed component other than alkali metal hydroxide. The anodizing solutions typically are strongly basic (e.g., pH of 11 or higher).

Although the concentration of alkali metal hydroxide is not believed to be particularly critical, the anodizing solution typically will contain from about 10 to about 60 g/L or from about 0.1 to about 1.1M alkali metal hydroxide.

This embodiment of the invention is capable of forming coatings on magnesium articles (especially articles comprised of AZ-91 alloy) which have equivalent or superior corrosion resistance as compared to coatings obtained using the anodizing solutions described in Embodiment A, even at thinner coating thickness (e.g., O.5 to 2 microns).

With the aforedescribed anodizing solutions, 1 to 2 micron thickness coatings may be formed by applying pulsed direct current having an average voltage of about 30 to 50 volts (peak voltage about 130 to about 220 volts) for 1 to 3 minutes. Typically, the average voltage in this embodiment of the invention does not exceed about 100 volts.

It is believed that water-soluble or water-dispersible oxysalts of other elements such as boron, tin, tungsten, and molybdenum may also be utilized in combination with water to provide anodizing solutions useful in the present invention. Suitable oxysalts thus may include various salts of boric acid, stannic acid, tungstic acid, and molybdic acid with monovalent to trivalent metals (e.g., alkali metals), ammonia or organic amines such as borates, tungstates, molybdates, and stannates.

Before being subjected to anodic treatment in accordance with the invention, the light metal article preferably is subjected to a cleaning and/or degreasing step. For example, the article may be chemically degreased by exposure to an alkaline cleaner such as, for example, a diluted solution of PARCO Cleaner 305 (a product of the Henkel Surface Technologies division of Henkel Corporation, Madison Heights, Mich.). After cleaning, the article preferably is rinsed with water. Cleaning may then, if desired, by followed by etching with an acid, such as, for example, a dilute aqueous solution of an acid such as sulfuric acid, phosphoric acid, and/or hydrofluoric acid, followed by additional rinsing prior to anodization. Such pre-anodization treatments are well known in the art.

The protective coatings produced on the surface of the light metal article may, after anodization, be subjected to still further treatments such as painting, sealing and the like.

EXAMPLES

Examples 1–4

Anodizing solutions were prepared using the components shown in Table 1. Pulsed DC (30 milliseconds on time, 30 milliseconds off time) was applied for approximately 2 minutes. The rate of film deposition on magnesium-containing articles was approximately 10–15 microns per minute. The specimens produced in Examples 1 and 2 were scribed and subjected to salt fog testing (ASTM Method B-117). No corrosion was observed after 240 hours.

The coating on the anodized specimen was analyzed by SEM/EDS and found to have the following elemental composition:

| | Wt % | At % |
|---|---|---|
| C | 10.66 | 17.77 |
| O | 34.57 | 43.27 |
| Mg | 21.92 | 18.06 |
| Al | 3.27 | 2.43 |

-continued

| | Wt % | At % |
|---|---|---|
| P | 24.8 | 16.03 |
| K | 4.79 | 2.45 |
| Total | 100 | 100 |

Example 5

A 50% aqueous solution of potassium silicate was utilized as the anodizing solution. Pulsed DC was applied as described in Examples 1–4. A sustained plasma (as indicated by a blue glowing discharge) was observed at an average voltage of 50 volts (peak voltage=200 volts). A coating approximately 2.5 microns in thickness was deposited on the specimen after 2 minutes.

Examples 6–7

Anodizing solutions were prepared using the components shown in Table 2, with the pH of the solution to 8.0 being adjusted using ammonia (Example 6 required 5.4 g concentrated aqueous ammonia).

The anodizing solution of Example 7 was used to anodize 1"×4" samples of AZ91 magnesium alloy. A visible light-emitting discharge which was green in color was observed when 60 Hz AC was applied at 88 volts (peak voltage controlled by means of a VARIAC voltage control apparatus) at 7–9 amperes. After 5 minutes of anodization, a coating 0.07 mils in thickness had been formed. Using pulsed square wave DC (approximate shape, 10 milliseconds on and 30 milliseconds off, with 0 volts as the minimum). the discharge was periodic and white in color. Average voltage was 30 volts (average peak voltage=200 volts, with transient peak at 300 volts). The rate of coating formation (typically, 0.2 to 0.4 mils in 2 minutes) was much higher than when 60 Hz AC was employed.

Example 8

An anodizing solution was prepared using 100 g/L 75% phosphoric acid, and 220 g/L 45% potassium hydroxide, with deionized water providing the balance of the anodizing solution. The phosphate concentration thus was 0.77 M. Coating deposition rates of 7.5 to 12.5 microns per minute were obtained on magnesium substrates using this anodizing solution. On aluminum substrates, the observed coating deposition rates were 1 to 2.5 microns per minute. Using pulsed DC, average voltage during anodization was 23 volts, with the peak voltage being 100 volts (with the exception of a transient voltage spike to 155 volts).

TABLE 1

| | 1 | | 2 | | 3 | | 4 | |
|---|---|---|---|---|---|---|---|---|
| Example | g/L | M | g/L | M | g/L | M | g/L | M |
| Amine | | | | | | | | |
| Triethanolamine | 74 | 0.50 | 85.0 | 0.57 | — | — | — | — |
| JEFFAMINE | — | — | — | — | 51.6 | 0.12 | 51.6 | 0.12 |

TABLE 1-continued

| Example | 1 g/L | 1 M | 2 g/L | 2 M | 3 g/L | 3 M | 4 g/L | 4 M |
|---|---|---|---|---|---|---|---|---|
| T-403 Alkali Metal Hydroxide | | | | | | | | |
| NaOH | 85 | 2.13 | — | — | — | — | — | — |
| KOH | — | — | 59.7 | 1.06 | 64.4 | 1.15 | 77.4 | 1.38 |
| Phosphoric Acid | 82.5 | 0.84 | 48.8 | 0.50 | 65.6 | 0.67 | 65.6 | 0.67 |
| pH | 11.4 | | 11.2 | | 7.4 | | 8.9 | |
| Average Voltage at which Sustained Plasma Observed | 60–80 | | 110–130 | | 25–50 | | 55 | |
| Peak Voltage | 200 | | 200 | | 100 | | 150 | |

TABLE 2

| Example | 6 | 7 |
|---|---|---|
| $H_2TiF_6$, g | 80.0 | — |
| $H_2ZrF_6$ (20% aq. Solution), g | — | 175 |
| Ammonium Bifluoride, g | 7.0 | 7.0 |
| Deionized Water, g | 780 | 740 |
| Chelating Agent[1], g | 10.0 | — |

[1]VERSENE 100, a product of Dow Chemical Company

Example 9

An anodizing solution was prepared using 10 g/L sodium fluosilicate ($Na_2SiF_6$), the pH of the solution being adjusted to 9.7 using KOH. A magnesium-containing article was subjected to anodization for 45 seconds in the anodizing solution using pulsed direct current having a peak ceiling voltage of 440 volts (approximate average voltage=190 volts). The "on" time was 10 milliseconds, the "off" time was 10 milliseconds (with the "off" or baseline voltage being 50% of the peak ceiling voltage). A uniform coating 3.6 microns in thickness was formed on the surface of the magnesium-containing article. During anodization, the plasma generated was initially continuous, but then became periodic.

Example 10

A magnesium-containing article was subjected to anodization for 45 seconds in the anodizing solution of Example 9 using pulsed direct current having a peak ceiling voltage of 500 volts (approximate average voltage=75 volts). The "on" time was 10 milliseconds, the "off" time was 30 milliseconds (with the "off" or baseline voltage being 0% of the peak ceiling voltage). A uniform coating 5.6 microns in thickness was formed on the surface of the magnesium-containing article. During anodization, the plasma generated was initially continuous, but then become periodic.

Example 11

An anodizing solution was prepared using the following components:

| | Parts by Weight |
|---|---|
| Zirconium Basic Carbonate | 5.24 |
| Fluozirconic Acid (20% solution) | 80.24 |
| Deionized Water | 914.5 |

The pH was adjusted to 3.9 using ammonia. An aluminum-containing article was subjected to anodization for 120 seconds in the anodizing solution using pulsed direct current having a peak ceiling voltage of 450 volts (approximate average voltage=75 volts). The other anodization conditions were as described in Example 10. A uniform white coating 6.3 microns in thickness was formed on the surface of the aluminum-containing article. A periodic to continuous plasma (rapid flashing just visible to the unaided human eye) was generated during anodization.

Example 12

An anodizing solution was prepared using the following components:

| | Parts by Weight |
|---|---|
| $KMnO_4$ | 8 |
| Deionized Water | 990 |
| $H_2SO_4$ (97%) | 2.0 |

The pH of the anodizing solution was 1.6. An aluminum-containing article was subjected to anodization in the anodizing solution under the same conditions as described in Example 11, except that the peak ceiling voltage was 540 volts (average voltage=150 volts). A uniform golden-bronze coating 6.1 microns in thickness was formed on the surface of the aluminum-containing article. Due to the color of the anodizing solution, it was difficult to determine if a plasma was generated during anodization.

Example 13

An anodizing solution was prepared by combining 333 parts by weight zinc ammonium zirconium carbonate solution with 667 parts by weight deionized water. The zinc ammonium zirconium carbonate solution is a clear alkaline aqueous solution supplied by Magnesium Elektron, Inc. (Flemington, N.J.) under the trademark PROTEC ZZA and is reported to contain 16% total active $ZrO_2$ and ZnO. The anodizing solution had a pH of 9.6 and a distinct odor of ammonia.

An article comprised of 6063 aluminum was subjected to anodization in the anodizing solution under the same conditions as described in Example 11, except that the peak ceiling voltage was 450 volts (approx. average voltage=100 volts) and the anodization time was 80 seconds. A uniform tan-grey coating 6.2 microns in thickness was formed on the surface of the article. During anodization, a continuous bright white-blue plasma was observed. These results were unexpected, since anodization of aluminum is normally carried out using acidic, not basic, anodizing solutions.

Example 14

Example 13 was repeated using an article comprised of AZ-91 magnesium. The peak ceiling voltage was 500 volts (approximate average voltage=100 volts) and the anodization time was 90 seconds. A uniform tan coating 7.6 microns in thickness was formed on the surface of the article. During anodization, a continuous bright white-blue plasma was observed.

Example 15

An anodizing solution having a pH of 13.2 was prepared by combining sodium ammonium decavanadate (concentration=5 g/L), VERSENE 220 chelating agent (concentration=7.5 g/L), and potassium hydroxide (concentration=37.5 g/L) in water.

An article comprised of AZ91 magnesium was subjected to anodization in the anodizing solution for 60 seconds using pulsed direct current having an average voltage of 75 volts (300 volts peak voltage). During anodization, a periodic plasma was observed. A coating 2.0 microns in thickness was formed on the surface of the article. A coated panel produced in this manner was scribed and subjected to salt spray testing (ASTM method B-117). No corrosion was observed after 240 hours.

By way of comparison, this example was repeated using 60 Hz alternating current (standard sine wave AC from power company reduced to 800 volts using a VARIAC variable voltage transformer). No plasma was observed during anodization. Salt spray corrosion resistance of the coating produced was comparable to that of the coating obtained using pulsed direct current. To achieve a coating thickness of 1.2 microns, however, an anodization time of 10 minutes was required.

What is claimed is:

1. A method of forming a protective coating on a surface of a light metal-containing article, said method comprising:

A) providing an anodizing solution comprised of water and one or more additional components selected from the group consisting of:

a) water-soluble and water-dispersible oxysalts containing at least one element selected from the group consisting of Mn, Zr, Ti, V and Hf; or b) water-soluble and water-dispersible complex fluorides of elements selected from the group consisting of Ti, Zr, Hf, Si, Sn, Al, Ge and B;

B) providing a cathode in contact with said anodizing solution;

C) placing said light metal-containing article as an anode in said anodizing solution; and D) passing a pulsed current having an average voltage of not more than 250 volts between the anode and cathode though said anodizing solution for a time effective to form said protective coating on said surface.

2. The method of claim 1 wherein the light metal-containing article is comprised of magnesium.

3. The method of claim 1 wherein the light metal-containing article is comprised of aluminum.

4. The method of claim 1 wherein said anodizing solution is maintained at a temperature of from 5° C. to 90° C. during step (D).

5. The method of claim 1 wherein said pulsed current has an average voltage of not more than 200 volts.

6. The method of claim 1 wherein a visible light-emitting discharge is generated during step (D).

7. The method of claim 1 wherein during step (D) said protective coating is formed at a rate of at least 1 micron thickness per minute.

8. The method of claim 1 wherein during step (D) said protective coating is formed at a rate of at least 5 microns thickness per minute.

9. The method of claim 1 wherein said pulsed current has an average voltage of not more than 175 volts.

10. The method of claim 1 wherein said pulsed current is direct current.

11. A method of forming a protective coating on a surface of a light metal-containing article, said method comprising:

A) providing an anodizing solution comprised of water and one or more additional components selected from the group consisting of:

a) water-soluble and water-dispersible oxysalts containing at least one element selected from the group consisting of P, Mn, Zr, Ti, V arid Hf; or b) water-soluble and water-dispersible complex fluorides of elements selected from the group consisting of Ti, Zr, Hf, Si, Sn, Al, Ge end B;

c) water-soluble and water-dispersible alkali metal fluorides; and d) water-soluble and water-dispersible alkali metal hydroxides;

e) providing a cathode in contact with said anodizing solution;

B) placing said light metal-containing article as an anode in said anodizing solution; and C) passing a pulsed current having an average voltage of not more than 250 volts between the anode and cathode though said anodizing solution for a time effective to form said protective coating on said surface; and wherein the anodizing solution is essentially free of ammonia, chromium, permanganate, borate, sulfate.

12. The method of claim 11 wherein the anodizing solution is comprised of water and a concentration of phosphorus atoms in the form of phosphate that is at least 0.3 M.

13. The method of claim 11 wherein the anodizing solution is comprised of water and phosphate, but is essentially free of ammonia and amines.

14. A method of forming a protective coating on a surface of a light metal-containing article, said method comprising:

D) providing an anodizing solution comprised of water and one or more additional components selected from the group consisting of:

a) water-soluble and water-dispersible oxysalts containing at least one element selected from the group consisting of P, Si, Mn, Zr, Ti, V and Hf; or b) water-soluble and water-dispersible complex fluorides of elements selected from the group consisting of Ti, Zr, Hf, Si, Sn, Al, Ge and B;

c) water-soluble and water-dispersible alkali metal fluorides; and d) water-soluble and water-dispersible alkali metal hydroxides;

e) providing a cathode in contact with said anodizing solution;

E) placing said light metal-containing article as an anode in said anodizing solution; and F) passing a pulsed current having an average voltage of not more than 250 volts between the anode and cathode though said anodizing solution for a time effective to form said protective coating on said surface; and wherein the anodizing solution is comprised of water, a concentration of phosphorus atoms in the form of phosphate that is at least 0.3 M and at least one water-soluble organic amine.

15. The method of claim 14 wherein the water-soluble organic amine is selected from the group consisting of alkanolamines, polyetheramines, and mixtures thereof.

16. A method of forming a protective coating on a surface of a light metal-containing article, said method comprising:

A) providing an anodizing solution comprised of water and one or more additional components selected from the group consisting of:

a) water-soluble and water-dispersible oxysalts containing at least one element selected from the group consisting of P, Si, Mn, Zr, Ti, V and Hf; or b) water-soluble and water-dispersible complex fluorides of elements select from the group consisting of Ti, Zr, Hf, Si, Sn, Al, Ge and B;

c) water-soluble and water-dispersible alkali metal fluorides; and d) water-soluble and water-dispersible alkali metal hydroxides;

a) providing a cathode in contact with said anodizing solution;

B) placing said light metal-containing article as an anode in said anodizing solution; and C) passing a pulsed current having an average voltage of not more than 250 volts between the anode and cathode though said anodizing solution for a time effective to form said protective coating on said surface; and wherein the anodizing solution is comprised of water and a complex fluoride selected from the group consisting of $H_2TiF_6$, $H_2ZrF_6$, $H_2HfF_6$, $H_2SiF_6$, $H_2GeF_6$, $H_2SnF_6$, $H_3AlF_6$, $HBF_4$ and salts and mixtures thereof.

17. The method of claim 16 wherein the anodizing solution is additionally comprised of HF or a salt thereof.

18. The method of claim 16 wherein the anodizing solution is additionally comprised of a chelating agent.

19. The method of claim 16 wherein the anodizing solution is additionally comprised of an amine, ammonia, or mixture thereof.

20. A method of forming a protective coating on, a surface of a metallic article comprised of aluminum, magnesium or a mixture thereof, said method comprising:

A) providing an anodizing solution comprised of water and a concentration of phosphorus atoms in the form of phosphate that is at least 0.3 M but essentially free of ammonia, chromium, permanganate, borate, sulfate, free fluoride and free chloride;

B) providing a cathode in contact with said anodizing solution;

C) placing said metallic article as an anode in said anodizing solution; and

D) passing a pulsed direct current having an average voltage of not more than 150 volts between the anode and the cathode for a time effective to generate a visible light-emitting discharge and form said protective coating on said surface.

21. The method of claim 20 wherein said anodizing solution is additionally comprised of a water-soluble amine selected from the group consisting of alkanolamines, polyether amines, and mixtures thereof.

22. The method of claim 21 wherein said anodizing solution is comprised of at least about 0.05 M of said water-soluble amine.

23. The method of claim 20 wherein said pulsed direct current has an average voltage of not more than 60 volts.

24. The method of claim 20 wherein said anodizing solution is comprised of a concentration of phosphorus atoms in the form of phosphate that is at least 0.5 M.

25. The method of claim 20 wherein said phosphate is comprised of a potassium salt of phosphoric acid.

26. A method of forming a protective coating on a surface of a metallic article comprised of aluminum, magnesium or a mixture thereof, said method comprising:

A) providing an anodizing solution comprised of water and a water-soluble silicate having a pH of from about 8 to not more than 12;

B) providing a cathode in contact with said anodizing solution;

C) placing said metallic article as an anode in said anodizing solution; and

D) passing a pulsed direct current having an average voltage of no more than 100 volts between the anode and the cathode to generate a visible light-emitting discharge and to form said protective coating on said surface.

27. The method of claim 26 wherein the anodizing solution contains a concentration of silicon atoms in the form of silicate that is at least about 0.4 M.

28. The method of claim 26 wherein the anodizing solution is essentially free of ammonia, chromium, permanganate, borate, sulfate, free fluoride and free chloride.

29. The method of claim 26 wherein the anodizing solution is comprised of water and a concentration of silicon atoms in the form of alkali metal silicate that is at least about 0.4 M.

30. The method of claim 29 wherein said pulsed current has an average voltage of not more than 75 volts.

31. A method of forming a protective coating on a surface of a metallic article comprised of aluminum, magnesium or a mixture thereof, said method comprising:

A) providing an anodizing solution comprised of water and a water-soluble complex fluoride of an element selected from the group consisting of Ti, Zr, Hf, Si, Sn, Al, Ge, B and combinations thereof;

B) providing a cathode in contact with said anodizing solution;

C) placing said metallic article as an anode in said anodizing solution; and

D) passing a pulsed direct current having an average voltage of not more than 125 volts between the anode and the cathode for a time effective to generate a visible light-emitting discharge and to form said protective coating on said surface.

32. The method of claim 31 wherein the complex fluoride comprises an anion comprising at least 4 fluorine atoms and at least one atom selected from the group consisting of Ti, Zr, Si, and combinations thereof.

33. The method of claim 31 wherein the complex fluoride is selected from the group consisting of $H_2TiF_6$, $H_2ZrF_6$, $H_2SiF_6$, and salts and mixtures thereof.

34. The method of claim 31 wherein said complex fluoride is present in the anodizing solution at a concentration of at least 0.1 M.

35. The method of claim 31 wherein the anodizing solution is additionally comprised of hydrofluoric acid, a salt of hydrofluoric acid, or a mixture thereof.

36. The method of claim 31 wherein the anodizing solution is additionally comprised of a chelating agent.

37. The method of claim 31 wherein the anodizing solution is additionally comprised of at least one compound which is an oxide, hydroxide, carbonate or alkoxide of at least one element selected from the group consisting of Ti, Zr, Si, Hf, Sn, B, Al and Ge.

38. The method of claim 31 wherein the anodizing solution has a pH of from about 3 to about 11.

39. A method of forming a protective coating on a surface of a metallic article comprised of aluminum, magnesium or a mixture thereof, said method comprising:

A) providing an anodizing solution, said anodizing solution having been prepared by dissolving a water-soluble complex fluoride of an element selected from the group consisting of Ti, Zr, Hf, Si, Sn, Ge, B and combinations thereof and an inorganic acid or salt thereof that contains fluorine but does not contain any of the elements Ti, Zr, Hf, Si, Sn, Ge or B in water and said anodizing solution having a pH of from about 3 to about 11;

B) providing a cathode in contact with said anodizing solution;

C) placing said metallic article as an anode in said anodizing solution; and

D) passing a pulsed direct current having an average voltage of not more than 125 volts between the anode and the cathode for a time effective to generate a visible light-emitting discharge and form said protective coating on said surface.

40. The method of claim 39 wherein the pH of the anodizing solution is adjusted using ammonia an amine, an alkali metal hydroxide or a mixture thereof.

41. The method of claim 39 wherein the inorganic acid is hydrogen fluoride or a salt thereof.

42. The method of claim 39 wherein the anodizing solution is additionally comprised of a chelating agent.

43. The method of claim 39 wherein the anodizing solution is additionally comprised of at least one compound which is an oxide, hydroxide, carbonate or alkoxide of at least one element selected from the group consisting of Ti, Zr, Si, Hf, Sn, B, Al and Ge.

44. A method of forming a protective coating on a surface of a metallic article comprised of aluminum, magnesium or a mixture thereof, said method comprising A) providing an anodizing solution comprised of water and a water-soluble permanganate;

B) providing a cathode in contact with said anodizing solution;

C) placing said metallic article as an anode in said anodizing solution; and

D) passing a pulsed direct current having an average voltage of not more than 200 volts between the anode and the cathode for a time effective to generate a visible light-emitting discharge and form said protective coating on Said surface.

45. The method of claim 44 wherein the anodizing solution is additionally comprised of a mineral acid.

46. The method of claim 44 wherein said water-soluble permanganate is present in the anodizing solution at a concentration of at least about 0.01 M.

47. A method of forming a protective coating on a surface of a metallic article comprised of aluminum, magnesium or a mixture thereof, said method comprising A) providing an anodizing solution, said anodizing solution having been prepared by dissolving a water-soluble complex fluoride of zirconium or salt thereof and an oxide, hydroxide, carbonate or alkoxide of zirconium in water and said anodizing solution having a pH of from about 3 to 5;

B) providing a cathode in contact with said anodizing solution;

C) placing said metallic article as an anode in said anodizing solution; and

D) passing a pulsed direct current having an average voltage of not more than 125 volts between the anode and the cathode for a time effective to generate a visible light-emitting discharge and form said protective coating on said surface.

48. The method of claim 47 wherein $H_2ZrF_6$ or a salt thereof is used to prepare the anodizing solution.

49. The method of claim 47 wherein zirconium basic carbonate is used to prepare the anodizing solution.

50. The method of claim 47 wherein the pH of the anodizing solution is adjusted using a base.

51. The method of claim 47 wherein the anodizing solution has been prepared by dissolving about 0.1 to about 1 weight percent zirconium basic carbonate and about 10 to about 16 weight percent $H_2ZrF_6$ or salt thereof in water and adding a base if necessary to adjust the pH of the anodizing solution to between about 3 and about 5.

52. A method of forming a protective coating on a surface of a metallic article comprised of aluminum, magnesium, or a mixture thereof, said method comprising:

A) providing an anodizing solution comprised of water and a water-soluble compound
selected from the group consisting or titanates, zirconates, and mixtures thereof;

B) providing a cathode in contact with said anodizing solution;

C) placing said metallic article as an anode in said anodizing solution; and

D) passing a pulsed direct current having an average voltage of no more than 150 volts
between the anode and the cathode to generate a visible light-emitting discharge and to
form said protective coating on said surface.

53. The method of claim 52 wherein the anodizing solution is comprised of water-soluble zirconium carbonate.

54. The method of claim 52 wherein the anodizing solution is comprised of zinc ammonium m zirconium carbonate.

55. The method of claim 52 wherein the anodizing solution is comprised of a decavanadate.

56. The method of claim 55 wherein the anodizing solution is additionally comprised of a chelating agent.

57. The method of claim 55 wherein the anodizing solution has a pH of from 11 to 14.

58. A method of forming a protective coating on a surface of a metallic article comprised of aluminum, magnesium or a mixture thereof, said method comprising A) providing an anodizing solution comprised of water and a water-soluble alkali metal fluoride said anodizing solution comprising less than 2 g/L hydroxide;

A) providing a cathode in contact with said anodizing solution;

C) placing said metallic article as an anode in said anodizing solution; and

D) passing a pulsed direct current having an average voltage of not more than 125 volts between the anode and cathode through said anodizing solution for a time effective to form said protective coating on said surface.

59. The method of claim 58 wherein the water-soluble alkali metal fluoride is potassium fluoride.

60. The method of claim 58 wherein said anodizing solution is comprised of about 15 to about 45 g/L potassium fluoride, less than 0,5 g/L hydroxide, and less than i g/L silicate.

61. A method of forming a protective coating on a surface of a metallic article comprised of aluminum, magnesium or a mixture thereof, said method comprising:

A) providing an anodizing solution comprised of water and one or more water-soluble and/or water-dispersible alkali metal hydroxides, said anodizing solution being essentially free of any dissolved or dispersed component other than alkali metal hydroxide;

B) providing a cathode in contact with said anodizing solution;

C) placing said metallic article as an anode in said anodizing solution; and

D) passing a pulsed direct current having an average voltage of not more than about 100 volts between the anode and cathode through said anodizing solution for a time effective to form said protective coating on said surface.

62. The method of claim 61 wherein the water-soluble alkali metal hydroxide is potassium hydroxide.

63. The method of claim 61 wherein said anodizing solution is comprised of from about 0.1 to about 1.1M alkali metal hydroxide.

* * * * *

UNITED STATES PATENT AND TRADEMARK OFFICE

CERTIFICATE OF CORRECTION

PATENT NO. : 6,916,414 B2
DATED : July 12, 2005
INVENTOR(S) : Dolan

It is certified that error appears in the above-identified patent and that said Letters Patent is hereby corrected as shown below:

Title page,
Item [54], Title, delete "LIGHT METAL ANODIZATION" and insert -- METHOD OF LIGHT METAL ANODIZATION USING PULSED DIRECT CURRENT --.

Column 14,
Line 12, delete "arid" and insert -- and --.
Line 15, delete "end" and insert -- and --.

Column 15
Line 33, delete ",".

Column 17,
Line 20, after "ammonia," insert -- , --.
Line 45, delete "Said" and insert -- said --.

Column 18,
Line 19, delete "or" and insert -- of --.
Line 34, after "ammonium," delete "m".
Line 61, delete "0,5" and "i g/L" and insert -- 0.5 -- and -- l g/L --.

Signed and Sealed this

Ninth Day of May, 2006

JON W. DUDAS
*Director of the United States Patent and Trademark Office*